US005368689A

United States Patent [19]

Agnemo

[11] Patent Number: 5,368,689

[45] Date of Patent: Nov. 29, 1994

[54] PAPER AND A METHOD OF PAPER MANUFACTURE

[75] Inventor: Arne R. Agnemo, Domsjö , Sweden

[73] Assignee: Mo Och Domsjö Aktiebolag, Örnsköldsvik, Sweden

[21] Appl. No.: 66,109

[22] PCT Filed: Nov. 25, 1991

[86] PCT No.: PCT/SE91/00798

§ 371 Date: Jun. 3, 1993

§ 102(e) Date: Jun. 3, 1993

[87] PCT Pub. No.: WO92/09745

PCT Pub. Date: Jun. 11, 1992

[30] Foreign Application Priority Data

Dec. 3, 1990 [SE] Sweden ..... 9003830-8

[51] Int. Cl.[5] ..... D21H 21/38

[52] U.S. Cl. ..... 162/135; 162/142; 162/150; 162/158; 162/160; 162/181.2; 162/181.3

[58] Field of Search ..... 162/160, 181.3, 181.2, 162/158, 142, 150, 135; 427/395; 106/287.23, 287.24

[56] References Cited

U.S. PATENT DOCUMENTS

| | | | |
|---|---|---|---|
| 2,154,996 | 4/1939 | Rawling | 162/160 |
| 3,393,122 | 7/1968 | Marshall | 162/27 |
| 3,619,355 | 11/1971 | Silberman | 162/160 |
| 4,871,423 | 10/1989 | Grimsley et al. | 162/72 |
| 5,080,754 | 1/1992 | Francis et al. | 162/150 |

*Primary Examiner*—Peter Chin
*Attorney, Agent, or Firm*—Sughrue, Mion, Zinn, Macpeak & Seas

[57] ABSTRACT

The present invention reduces the normally marked yellowing of paper which is at least partially based on lignin-containing pulps.

The invention relates to paper produced from fibre material and other paper ingredients in the form of at least one chemical. The fibre material at least partially consists of pulp that contains lignin in an amount exceeding 0.5 percent by weight, and is characterized in that the paper includes a) an acid and/or a corresponding salt of the general formula (the acid form)

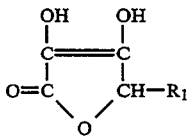

where $R_1$=—CHOHCH$_2$OH or —CHOHCOOH in an amount of at least 0.05 percent by weight, calculated on the fibre material; and b) a reduction agent in an amount of at least 0.05 percent by weight, calculated on the fibre material.

14 Claims, No Drawings

PAPER AND A METHOD OF PAPER MANUFACTURE

TECHNICAL FIELD

The invention relates to paper which, with regard to the fibre part, is based on material which at least consists partially of lignin-containing pulp. Examples of this type of pulp are so-called high yield pulps, such as groundwood pulps (conventional and pressure), thermomechanical pulps and chemi-thermomechanical pulps. These and other pulps mentioned in this specification are, in turn, produced from any kind of lignocellulosic material whatsoever, including wood. The invention relates primarily to paper of the newsprint kind (conventional and so-called improved), wood-containing printing and writing paper, for instance magazine paper, such as super calandered (SC) paper, low weight coated (LWC) paper, medium weight coated (MWC) paper, white liner and fine paper, both coated and uncoated. As used in the present specification, the term paper also includes different types of paperboard.

The invention also relates to a method for producing the aforedescribed papers.

BACKGROUND ART

In present-day processes and also in past manufacturing processes, the fibre part of the aforesaid papers comprises/comprised varying quantities of lignin-containing pulp. The remaining fibre quantity normally consists of lignin-free pulp, such as bleached chemical pulp. Lignin-containing pulps, for example high yield pulps, provide several advantages when used as paper ingredients. One advantage is that this type of pulp, even when bleached, is cheaper than chemical pulps in general, and particularly bleached chemical pulps. Another advantage is that several properties of the paper can be improved when the fibre part of the paper includes a given quantity of high yield pulp, as compared with paper which is based solely on chemical pulp. Examples of such properties are opacity (non-transparency), stiffness and bulk.

The big drawback with mixing high yield pulps in paper is that the paper becomes pronouncedly discoloured (yellows) with time. All pulps, and consequently all paper that is based on pulps, will yellow with time. A bleached chemical pulp which contains solely carbohydrates and no lignin at all will also yellow to a certain extent. The extent to which these pulps yellow, however, cannot be compared with the yellowing of pulps that contain lignin. In the case of this latter pulp, yellowing is dominated by the lignin and is accelerated by contact of the fibres with light. This accelerated yellowing of the pulps is caused particularly by the shortwave part of the light, i.e. that part of the light which has a wavelength beneath 425 nm. This drawback of high yield pulps has delayed the use of such pulps in general and/or has at least limited the percentage admixture of such pulps in the fibre part of paper of the aforedescribed type.

Several proposals have been made with regard to limiting the yellowing (improving the brightness stability) of paper which is based completely or partially on lignin-containing pulp.

One method is to reduce the amount of shortwave light, which penetrates the paper. This can be achieved, for instance, by adding to the paper a pigment which has a pronounced ability of spreading shortwave light, as taught in the article "Ny metod mot gulnande papper" by Kenneth Leverback, Kemisk Tidskrift 1990, No. 10, pages 38–39, or by introducing into the paper chemicals which will convert ultraviolet light to heat. This latter type of chemical is normally an organic substance having a phenolic structure.

Another method of limiting the yellowing of lignin-containing pulp and of paper produced therefrom is described in the Swedish Patent Application No. 8700843-9 (EPC Application No. 0 280 332). There is told that bleached lignin-containing pulp is reacted with a reduction agent, for example, and preferably, sodium borydride, in an after treatment process carried out already in the pulp mill. According to the simplest embodiment of the claimed method, a fluroescent chemical, for example an optical whitener, is then introduced to the pulp. This procedure can either be carried out directly on the pulp in the pulp mill or in the paper mill to paper produced from the pulp, for example when surface sizing or surface coating the paper.

DISCLOSURE OF THE INVENTION

Technical problems

Although the aforedescribed methods, and particularly the latter method, will appreciably limit the extent to which paper comprised at least partially of lignincontaining pulp will yellow, there is a need of alternative solutions which are effective both from a functional aspect and from the aspect of cost.

Solution

The present invention provides one such solution and relates to paper produced from fibre material which comprises at least partially pulp which contains lignin in an amount exceeding 0.5 percent by weight, and of at least one chemical, including retention agent and/or hydrophobizing agent and/or dry strength agent, and is characterized in that the paper includes a) an acid and/or corresponding salt of the general formula (the acid form)

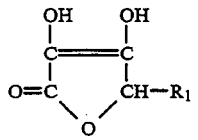

where $R_1$=—CHOHCH$_2$OH or —CHOHCOOH in a quantity of at least 0.05 percent by weight, calculated on the fibre material; and b) a reduction agent in an amount of at least 0.05 percent by weight, calculated on the fibre material.

Suitable additives according to a) are ascorbic acid, arabo-ascorbic acid, saccharo ascorbic acid and xyloascorbic acid and/or their salts.

Ascorbic acid has been found very suitable in the present context, and particularly the L-form of the acid and/or its salt. The L-form is to be preferred also with regard to the remaining acids and/or their salts, with the exception of xylo-ascorbic acid and/or its salt, where the D-form is to be preferred.

The reduction agent according to b) may be any kind of reduction agent whatsoever, such as boron hydride, dithionite, hydrazine, thiourea-dioxide and hydrogen sulphite/sulphite. Catalytic hydration can also be used. The reduction agents preferred are those which are both effective and which command a low price. Additives which include hydrogen sulphite and/or sulphite are particularly preferred.

As suitable fibre mixture and admixture of additives of the two aforedescribed types will result in a paper whose initial brightness exceeds 70% ISO, measured according to SCAN-C 11:75. In general, all brightness values recited in this specification, i.e. with regard to the different pulps and also to the different papers, are measured in accordance with this method. Another characteristic of the paper is that it has good brightness stability, meaning that the light absorption coefficient of the paper is beneath 1.50 $m^2/kg$ measured according to SCAN-C 11:75, subsequent to irradiating the paper with a Landau zenon lamp for two hours.

The additives according to a) and b) above may advantageously be uniformly distributed within the paper, i.e. also seen in the cross-section area of the paper. It is preferred, however, to concentrate the agents at the surface of the paper, i.e. one or both surface parts thereof.

The scope of the present invention includes several sorts of paper, i.e. both existing types of paper and future types. Examples of present-day, common paper types according to the invention and their construction are disclosed in the following.

70–100% of the fibre part of newsprint consists of mechanical pulp, i.e. unbleached groundwood pulp or unbleached thermomechanical pulp, and 30–0% of chemical pulp. The paper may contain small quantities of pigment. Examples of pigment are calcinated clay, aluminium hydroxide, silicates and organic compounds. These pigments may be introduced either individually or in mixture. The paper will normally also include a retention agent, for example of the kind polyacrylamide, polyethylene imine or a multicomponent system consisting, for instance, of polyethylene oxide and phenol resin. Nuancing dyes are sometimes added. The surface weight of newsprint normally lies within the range of 40–50 $g/m^2$.

So-called improved newsprint normally includes bleached mechanical pulp, and may also contain small quantities of pigment and other additives, according to the above. Improved newsprint normally has a surface weight within the range of 50–70 $g/m^2$.

Examples of coated wood-containing paper are low weight coated (LWC) paper and medium weight coated (MWC) paper. The fibre composition of these papers can vary from 100% high yield pulp to a mixture of 50% high yield pulp and 50% chemical pulp. The surface weight of respective papers with regard to the fibre part is 35–45 $g/m^2$ and 45–75 $g/m^2$. The paper will normally include a retention agent and 5–10% mineralic pigment in the base paper, calculated on the dry paper. This paper is coated on both sides thereof with a coating agent (layers) in an amount of 5–20 g, calculated on dry weight per $m^2$. The coating agent is applied to the paper in the form of a paste which contains one or more of the substances taken from the following group; various kinds of pigment, for example clay and calcium carbonate, binder, such as latex, and starch, wet strength resin, carboxymethyl cellulose, nuancing dyes, etc.

Another type of paper is supercalandered (SC) paper, which normally has a surface weight of 50–80 $g/m^2$. The fibre part consists of a mixture of mechanical pulp and chemical pulp, for instance in the ratio of 70:30. The paper has a high filler content, about 20–30% calculated on the dry paper. The paper also contains retention agents in an amount, for instance, of 0–0.5%, calculated on the dry fibre content. The paper may also contain, at times, a hydrophobizing agent, such as alum and resin acid, in an amount of, for instance, 0–2%, calculated on the dry fibre content, an a low amount of nuancing dyes.

Another type of paper is fine paper. The surface weight of fine paper lies within the range of 40–140 $g/m^2$. The fibre part is made predominantly of chemical pulp, which normally constitutes 90–100% of the fibre part. The remaining fibre content, i.e. up to 10%, may consist of high yield pulp. The paper normally includes 5–30% filler, calculated on the dry paper, and a number of additives, such as hydrophobizing agent (0–1%), retention agent (0–0.5%), dry strength agent (for instance cationic starch in an amount of 0–4%), optical whiteners (0–2%) and a small quantity of nuancing dyes. Examples of fillers are clay, chalk, calcite, marble, talc and titanium dioxide. The next outermost layer, or the outermost layer of the paper, normally consists of a surface sizing layer, for instance in the form of some kind of starch. The amount used is 0–5 $g/m^2$ (calculated as dry weight). Alternatively, the outermost layer consists of a coating layer applied in an amount of 0–30 $g/m^2$ and side (calculated as dry weight). It will be understood from this that fine paper may be either uncoated or coated. The invention enables the high yield pulp proportion in fine paper to be increased to above 50%.

By paperboard is meant a paper product having a high surface weight, for instance a surface weight of 120–400 $g/m^2$, and which normally comprises several layers. Paperboard may contain both chemical pulp and high yield pulp. The mixture of these pulps varies markedly from manufacturer to manufacturer. Paperboard normally includes hydrophobizing agents and dry strength agents, but to a lesser extent fillers and retention agents.

A common feature of all paper according to the invention, including the aforedescribed papers, is that at least a part of the fibre material from which the paper is constructed consists of lignin-containing pulp, preferably high yield pulp. A preferred and essential feature of the invention is that this pulp is bleached in one or more stages. Such pulp is normally bleached with peroxide, although pulps which have been bleached with other bleaching agents, such as boron hydride and dithionite, for instance, are well-suited as an ingredient of the inventive paper.

Because the paper contains the additives a) and b) the paper manufacturer can be more selective with regard to the choice of pulp mixture.

Hitherto, reference has been made solely to different types of pulps as the source of fibre material. Naturally, the paper may also include a given proportion of other fibres, such as return fibres and regenerated fibres of different kinds, and also synthetic fibres.

The invention also relates to a method for manufacturing paper that contains fibre material which at least partially consists of pulp which contains lignin in an amount exceeding 0.5 percent by weight and at least one chemical, including retention agent and/or hydrophobizing agent and/or dry strength agent, characterized in that there is introduced to the paper at any position whatsoever after forming the paper a) an acid and/or corresponding salt of the general formula (acid form)

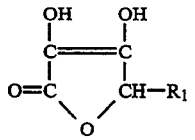

where $R_1$=—$CHOHCH_2OH$ or —CHOHCOOH in an amount of at least 0.05 percent by weight, calculated on the fibre material; and b) a reduction agent in an amount of at least 0.05 percent by weight, calculated on the fibre material.

The paper is formed from a stock, an aqueous suspension, which in addition to the earlier described fibre mixture also includes one or more of the earlier mentioned paper ingredients, such as retention agent, filler, pigment, hydrophobizing agent, nuancing dyes, etc. The pH of the stock lies within the range of 4–10. Subsequent to having passed through the headbox of the paper machine, the stock is fed onto a liquid-permeable wire, which is advanced at a given speed. As the wire advances, the stock is dewatered successively and the actual paper is formed. The fibre concentration of the stock is normally between 0.1–2%, and when forming of the paper is essentially complete, its dry solids content is about 3–7%. This dry solids content varies from case to case, i.e. in the so-called dry line of a paper machine.

Subsequent to forming the paper, both the additive a) and the additive b) according to the above are applied to the paper, preferably in the form of aqueous solutions. Examples of both suitable and preferred additives according to a) and b) have been earlier described. The additives concerned can either be applied to the paper separately or together.

Distribution of the additives in the cross-section of the paper is determined by the positioned at which the addition is made in the forward direction of movement of the paper and on the dry solids content of the paper at the time of making the addition.

A paper machine normally includes a press section and the additives can be delivered to the paper immediately upstream of, in or immediately downstream of the press section. When the paper is of a kind which is surfaced sized, the two additives may advantageously be delivered to the paper either when sizing the paper or in connection therewith. If the paper is coated, the two additives may advantageously be delivered to the paper when coating the paper or in connection therewith. The occasions represented by the words when and in connection with are equivalent additive supply positions or occasions. Naturally, the two additives can be delivered to the paper in several positions.

In those cases when both additives are supplied to the paper at the time of sizing or coating the paper, the additives may well be added in solid form (powder) to the sizing suspension and the coating paste respectively. On both of these occasions, and also when dissolving the additives concerned in solely water, the ascorbic acid addition will result in a pH which is considerably below 7. It is possible to adjust the pH of the solution to, e.g. the range of 6–9, with the aid of an alkali. By alkali is meant, for instance, sodium hydroxide, sodium carbonate, potassium hydroxide and ammonia. This means that the majority, and often a totally predominant part of the ascorbic acid present in the paper will have converted to a corresponding simple salt. Ascorbic acid has two pKa-values, namely $pKa_1=4.2$ and $pKa_2=11.6$. As a result, the ascorbic acid will release a hydrogen atom (proton) within the pH-range of 6–9, this atom being replaced, for instance, with a sodium atom. Naturally, the alkali may be based on a cation other than sodium and in such case, it is this ion which will replace the hydrogen ion. The preferred addition of respective chemicals lies within the range of 0.25–2 percent by weight, calculated on the fibre material.

Irrespective of the position in which the two additives are introduced to the paper, the paper is subsequently dried on drying cylinders in at least one step, at a highest cylinder temperature which exceeds 100° C. Highest cylinder temperatures up to 130° C. are normal.

Advantages

The yellowing of paper manufactured in accordance with the invention is so reduced as to approach the yellowing of paper that has been manufactured exclusively from bleached chemical pulp. As a result of the invention, it is possible to increase in the paper the quantity of fibres from lignin-containing pulps at the cost of the fibre quantity from lignin-free chemical pulps at a substantially unchanged quality and with regard to certain properties an improved result. This enables the manufacturing costs of the paper to be reduced, at least with some sorts of paper. This cost reduction is obtained for at least two reasons, firstly part of the expensive chemical pulp can be exchanged for a cheap high yield pulp, and secondly the surface weight of the paper can be reduced, leading to reduced fibre usage. Furthermore, the paper manufacturer has a greater degree of freedom in selecting the fibre composition of a given paper. As a result of the invention, those types of paper which already have a high proportion of fibres deriving from lignin-containing pulps have a markedly improved quality.

BEST MODE OF CARRYING OUT THE INVENTION

Down below are shown a number of Examples in which paper in accordance with the invention was constructed on a small, laboratory scale, and with which the inventive method has been simulated.

EXAMPLE 1

Two types of paper, one paper type for application of the invention and one wood free reference paper, were produced on a laboratory paper machine having a web width of 22 cm.

In the case of the first mentioned type of paper, 50 parts of bleached aspen groundwood pulp having a brightness of 84.9% ISO were mixed in a vessel, in water, with 50 parts of bleached softwood sulphate pulp having a brightness of 85.3% ISO, this pulp previously having been refined to a refining degree of 25 SR (Schopper-Riegler), such as to obtain a fibre suspension having a dry solids content pronouncedly beneath 1%. Filler in the form of marble sold under the trade name Hydrocarb 65 was added to another vessel which contained water, such as to obtain a solids content of 4%. These two suspensions were mixed in the ratio of 80 to 20, based on solids content in respective cases, so as to form a stock. As dry strength agent, there was added 0.8% cationic potatoe starch sold under the trade name Q-tac 300 B5, and a ketene dimer sold under the trade name Aquapel 239 was added as a hydrophobizing agent in a quantity of 3% (as a commercial product), calculated on the dry weight of the paper. Also added was a retention agent in the form of polyacrylamide sold under the trade name PAM HY 1141 in an amount of 0.008%, calculated on the dry weight of the paper, and Bentonit type clay having the designation HWE in a quantity of 0.05%, calculated on the dry weight of the paper. The pH of the stock was finally adjusted to 8.0, with the aid of sodium hydrogencarbonate.

When pumped into the headbox of the paper machine, the stock has a solids content of 0.2%. Subsequent to forming the paper on the wire section of the paper machine, the paper was introduced into a press section, whereafter the paper was dried with the aid of electrically heated cylinders at a highest cylinder temperature of 130° C. The paper machine terminated with paper sizing equipment with which the paper was sized with a starch sold under the trade name Perfect Amyl in an amount of 1.20 grams of absolutely dry starch per $m^2$ of paper. The starch was applied to the paper in the form of a 10%-solution. Prior hereto, powdered L-ascorbic acid and powdered sodium sulphite were added to the starch solution. This caused the pH of the suspension to fall significantly, and sodium hydroxide was therefore added to obtain a pH of 7.0. At a pH of 7.0, both hydrogen sulphite ions ($HSO_3^-$) and sulphite ions ($SO_3^{2-}$) exist in a 50/50 distribution. The paper had a dry solids content of 98% prior to the sizing process, the dry solids content fell to 75% and the paper was then dried with electrically heated cylinders at a highest cylinder temperature of 110° C., to a dry solids content of 96%. The finished paper had a surface weight of 60 $g/m^2$.

The tests hitherto described are concerned with the manufacture of paper in accordance with the invention. Further tests were carried out with a similar base paper for comparison purposes. In one of these tests, neither ascorbic acid nor sodium sulphite were added to the starch suspension. Further, only ascorbic acid was added to the starch suspension, in three different quantities, and solely sodium sulphite was added, in two different quantities.

A reference paper was also produced. This paper was produced in the manner already described. The difference lied solely in the fibre composition. The fifty parts of bleached aspen groundwood pulp were replaced with fifty parts of bleached birch sulphate pulp, which was refined to 20 SR. This pulp has a brightness of 85.8% ISO. The reference paper thus contained totally, i.e. to 100% fibres that derived from bleached chemical pulp, so-called wood free paper. The two chemicals characteristic of the present invention were not added to this paper.

The aforedescribed papers were obtained in the form of a roll at the end of the paper machine. Samples were taken from each roll and initial values relating to brightness from each roll and initial values relating to brightness and light absorption coefficient were measured. Further samples were taken and these samples were subjected to light aging and to heat aging, whereafter brightness and light absorption coefficient were determined. Light aging was determined by illuminating the papers with a Landautype xenon lamp for different periods of time, while heat aging was determined by placing the paper in a heated cabinet for 16 hours at a temperature of 120° C.

The amount of ascorbic acid and sodium sulphite added and the results achieved are disclosed in Table 1 below.

TABLE 1

| Test | Ascorbic acid | | Sodium Sulphite | | Initial | | Light Aging (hours) 1 | | 2 | | 3 | | 9 | | Heat Aging 120° C. 16 Hours | |
|---|---|---|---|---|---|---|---|---|---|---|---|---|---|---|---|---|
| No. | $g/m^2$ | % | $g/m^2$ | % | Brightness % ISO | Lac. $m^2/kg$ | Brightness | Lac. | Brightness | Lac. | Brightness | Lac. | Brightness | Lac. | Brightness | Lac. |
| 1 | 0 | | 0 | | 85.5 | 0.85 | 82.1 | 1.35 | 78.6 | 2.01 | 77.0 | 2.37 | 75.9 | 2.64 | 79.9 | 1.77 |
| 2 | 0.42 | 0.7 | 0 | | 84.1 | 1.05 | 82.1 | 1.36 | 79.6 | 1.82 | 81.0 | 1.55 | 78.3 | 2.09 | 77.3 | 2.32 |
| 3 | 0.73 | 1.2 | 0 | | 81.9 | 1.41 | 80.8 | 1.60 | 79.4 | 1.88 | 79.6 | 1.84 | 78.7 | 2.02 | 66.9 | 5.75 |
| 4 | 1.26 | 2.1 | 0 | | 81.3 | 1.48 | 78.7 | 1.97 | 78.5 | 2.02 | 79.3 | 1.85 | 76.8 | 2.40 | 66.0 | 6.00 |
| 5 | 0 | | 0.40 | 0.67 | 85.6 | 0.85 | 80.1 | 1.74 | 78.0 | 2.18 | 76.7 | 2.48 | 75.7 | 2.74 | 80.5 | 1.67 |
| 6 | 0 | | 1.08 | 1.8 | 85.9 | 0.84 | 82.2 | 1.40 | 79.4 | 1.94 | 78.2 | 2.21 | 76.6 | 2.59 | 81.6 | 1.51 |
| 7 | 0.36 | 0.6 | 0.33 | 0.55 | 85.6 | 0.87 | 83.9 | 1.10 | 83.1 | 1.22 | 82.4 | 1.34 | 81.3 | 1.53 | 82.2 | 1.37 |
| 8 | 0.64 | 1.1 | 0.58 | 0.97 | 85.8 | 0.84 | 83.9 | 1.11 | 82.6 | 1.32 | 81.8 | 1.46 | 80.3 | 1.74 | 81.3 | 1.55 |
| 9 | 0 | | 0 | | 88.7 | 0.46 | 85.5 | 0.78 | 84.2 | 0.94 | 83.1 | 1.08 | 82.1 | 1.23 | 85.0 | 0.94 |

Lac. is an abbreviation of light absorption coefficient.

The percentages recited for ascorbic acid and sodium sulphite relate to the dry quantity (the weight) of these substances in relation to the weight of the dry, ultimate paper.

As will be seen from the results disclosed above, where solely the tests 7 and 8 are in accordance with the invention, the two papers 7 and 8 initially exhibit, i.e. immediately after producing the paper, the same brightness values and the same light absorption coefficients as the paper 1, i.e. the starting paper to which neither ascorbic acid nor sodium sulphite were added. The two aging tests show, however, that the brightness stability of the two papers according to the invention is superior to the brightness stability of the starting paper. Subsequent to being irradiated over a period of, e.g., 9 hours with an xenon lamp (simulating day/sunlight radiation) the paper 1 had a brighness of 75.9% ISO and light absorption coefficient of 2.64, whereas the paper 7 according to the invention exhibited a brightness of 81.3% ISO and a light absorption coefficient of 1.53. During the heat aging test, the brightness of the paper 1 fell to 79.9% ISO, whereas the brightness of the paper 7 fell to only 82.2% ISO.

The tests 2–4, which relate to the addition of solely ascorbic acid to the paper, and in increasing quantities, surprisingly shows, that the initial brightness of the paper fell as a result of the ascorbic acid addition, and that the reduction in brightness increases with increasing addition quantities. The initial brightness of 85.5% ISO of the starting paper fell to 81.3% ISO when adding 2.1% ascorbic acid, calculated on the dry paper weight. With regard to light aging, however, the addition of ascorbic acid results in a slightly improved brightness stability compared with the starting paper. With regard to heat aging, the result of the ascorbic acid addition is catastrophically poor. Ascorbic acid is thus not heat stable. The reduction in the initial brightness of the paper when adding ascorbic acid is probably because when drying the paper, the paper is subjected to a highest cylinder temperature which exceeds 100° C. and reaches towards 130° C.

When adding solely sodium sulphite to the paper, the tests 5 and 6, the initial brightness is generally the same, or possibly somewhat improved in comparison with the starting paper. However, the addition of sodium sulphite had no brightness stabilizing effect with regard to light aging, whereas a certain improvement was obtained in comparison with the starting paper with regard to heat aging.

Surprisingly good results with regard to brightness stability were thus obtained with the inventive paper, i.e. the tests 7 and 8. When making a comparison between the inventive papers, for instance the paper 7 and the paper 9, which is a wood free reference paper, i.e. the fibre part of which was produced exclusively from bleached chemical pulp, it will be seen that the initial brightness of the reference paper 9 is about 3 units higher than the brightness of the inventive paper and that the initial light absorption coefficient of the reference paper 9 is only slightly more than half of the light absorption coefficient of the inventive paper. Subsequent to light aging the two papers for 9 hours, the difference in brightness was reduced to 0.8 units and the difference in light absorption coefficient was also significantly reduced.

EXAMPLE 2

Four further papers were produced in the aforedescribed manner.

The only difference between this test series and the test series described in Example 1 was that the 50 parts of bleached aspen groundwood pulp having a brightness of 84.9% ISO were replaced with 50 parts of bleached spruce groundwood pulp having a brightness of 75.3% ISO. Samples of the finished papers were taken and the brightness and light absorption coefficients of these papers were determined, partly initially and partly subsequent to light aging with the aid of an xenon lamp over a period of 1, 3 and 9 hours respectively. No heat aging tests were carried out.

The quantities in which ascorbic acid and sodium sulphite were added are disclosed in Table 2 below, together with the results obtained.

In the above Table, only the paper 13 is in accordance with and has been produced in accordance with the invention.

When solely ascorbic acid is added to the paper, the paper 11, the brightness is initially poorer than that of the starting paper, i.e. the paper 10. This addition also results initially in am impaired light absorption coefficient, i.e. the light absorption coefficient of the paper 11 is initially higher than that of the starting paper 10. The addition of ascorbic acid, however, stabilizes brightness to some extent, since after being irradiated for 9 hours with an xenon lamp, the paper 11 exhibited both higher brightness and lower light absorption coefficient in comparison with the starting paper 10 after subjecting this paper to similar irradiation.

The sodium sulphite addition, the paper 12, results in an increased initial brightness and decreased initial light absorption coefficient in comparison with the starting paper 10. This latter addition, however, does not result in stabilization of the brightness of the paper.

A markedly better result is shown by the paper 13, manufactured in accordance with the invention, i.e. where both ascorbic acid and sodium sulphite have been added to the paper. In comparison with the starting paper, the inventive paper exhibits both improved initial brightness and a markedly improved brightness stability.

EXAMPLE 3

A further five papers were produced in a test series in the manner described in Example 1.

The only difference was that the 50 parts of bleached aspen groundwood pulp having a brightness of 84.9% ISO were replaced with 50 parts of bleached chemithermomechanical pulp produced from aspen having a brightness of 85.3% ISO. Samples of the finished paper were taken and the brightness and light absorption coefficient of the paper determined, partly initially and partly after subjecting the paper to a light aging process with the aid of an xenon lamp over a period of 1, 2, 6 and 9 hours respectively. No heat aging tests were carried out.

The amount of ascorbic acid and sodium sulphite added are disclosed in Table 3 below, together with the results achieved.

TABLE 2

| Test No. | Ascorbic Acid kg/tonne Paper | Sodium Sulphite kg/tonne Paper | Initial Brightness % ISO | Initial Lac. $m^2/kg$ | Light Aging (hours) 1 Brightness | 1 Lac. | 3 Brightness | 3 Lac. | 9 Brightness | 9 Lac. |
|---|---|---|---|---|---|---|---|---|---|---|
| 10 | 0 | 0 | 82.7 | 1.34 | 79.0 | 2.05 | 76.4 | 2.68 | 73.5 | 3.51 |
| 11 | 25.2 | 0 | 81.0 | 1.76 | 78.9 | 2.23 | 78.2 | 2.46 | 76.0 | 3.00 |
| 12 | 0 | 8 | 83.9 | 1.12 | 80.6 | 1.70 | 78.4 | 2.18 | 75.6 | 2.88 |
| 13 | 7.2 | 5.5 | 83.8 | 1.14 | 82.1 | 1.42 | 80.5 | 1.72 | 79.4 | 1.95 |

Lac. is an abbreviation of light absorption coefficient.

TABLE 3

| Test No. | Ascorbic Acid kg/tonne Paper | Sodium Sulphite kg/tonne Paper | Initial Brightness % ISO | Initial Lac. $m^2/kg$ | Light Aging (hours) 1 Brightness | 1 Lac. | 3 Brightness | 3 Lac. | 6 Brightness | 6 Lac. | 9 Brightness | 9 Lac. |
|---|---|---|---|---|---|---|---|---|---|---|---|---|
| 14 | 0 | 0 | 84.7 | 0.71 | 80.7 | 1.18 | 76.4 | 1.86 | 75.6 | 2.01 | 74.0 | 2.33 |
| 15 | 22.2 | 0 | 82.1 | 1.03 | 80.4 | 1.26 | 78.0 | 1.64 | 75.9 | 2.02 | 74.7 | 2.27 |
| 16 | 0 | 18.8 | 86.4 | 0.58 | 81.3 | 1.16 | 79.0 | 1.51 | 77.2 | 1.82 | 75.4 | 2.17 |
| 17 | 7 | 6 | 86.6 | 0.56 | 83.1 | 0.93 | 82.1 | 1.05 | 79.3 | 1.46 | 78.0 | 1.68 |

TABLE 3-continued

| Test No. | Ascorbic Acid kg/tonne Paper | Sodium Sulphite kg/tonne Paper | Initial Brightness % ISO | Initial Lac. $m^2/kg$ | Light Aging (hours) 1 Brightness | 1 Lac. | 3 Brightness | 3 Lac. | 6 Brightness | 6 Lac. | 9 Brightness | 9 Lac. |
|---|---|---|---|---|---|---|---|---|---|---|---|---|
| 18 | 14.8 | 13.5 | 86.8 | 0.52 | 84.4 | 0.75 | 83.2 | 0.82 | 81.2 | 1.14 | 80.4 | 1.25 |

Lac. is an abbreviation of light absorption coefficient.

In this test series, the papers 17 and 18 are produced in accordance with the invention.

The results obtained were again similar to the two test series previously reported. When making comparisons internally between the two papers according to the invention, it was found that a marked improvement in brightness stabilization was obtained when the quantities of the two additives were doubled. In Example 1, on the other hand, a slightly improved brightness stability was obtained at the lower addition. This is possibly because the optimum addition quantity of these two additives is dependent on the type of lignin-containing pulp present in the paper.

The invention is not restricted to the aforedescribed embodiments thereof, since modifications and variations can be made within the scope of the present invention as defined in the following Claims.

I claim:

1. A paper produced from fibre material which consists at least partially of pulp that contains lignin in a quantity which exceeds 0.5 percent by weight, and of at least one chemical, including retention agent and/or hydrophobizing agent and/or dry strength agent, wherein the paper includes a) an acid and/or corresponding salt of the general formula (the acid form)

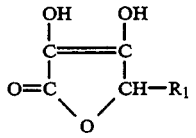

where $R_1$=—CHOHCH$_2$OH or —CHOHCOOH in an amount of at least 0.05 percent by weight, calculated on the fibre material; and b) a reduction agent in an amount of at least 0.05 percent by weight, calculated on the fibre material.

2. A paper according to claim 1, wherein the acid according to a) is ascorbic acid.

3. A paper according to claim 1 or 2, wherein the reduction agent according to b) is a substance that contains hydrogen sulphite and/or sulphite.

4. A paper according to claim 1, wherein its initial brightness exceeds 70% ISO, measured according to SCAN-C 11:75.

5. A paper according to claim 1, wherein its brightness stability is such that it has a brightness absorption coefficient of beneath 1.50 measured in $m^2/kg$ according to SCAN-C 11:75 after being irradiated with an xenon lamp for two hours.

6. A paper according to claim 1, wherein the additives according to a) and b) are concentrated to the surface of the paper.

7. A method for manufacturing paper comprising fibre material, which at least partially consists of pulp containing lignin in an amount exceeding 0.5 percent by weight, and at least one chemical, including retention agent and/or hydrophobizing agent and/or dry strength agent, wherein there is introduced to the paper in any position whatsoever after forming said paper a) an acid and/or corresponding salt of the general formula (the acid form)

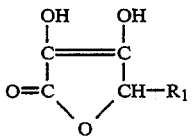

where $R_1$=—CHOHCH$_2$OH or —CHOHCOOH in an amount of at least 0.05 percent by weight, calculated on the fibre material; and b) a reduction agent in an amount of at least 0.05 percent by weight, calculated on the fibre material.

8. A method according to claim 7, wherein the stock from which the paper is formed has a pH of 4–10.

9. A method according to claims 7 or 8, wherein the additive according to a) is ascorbic acid.

10. A method according to claim 7, wherein the additive according to b) is a substance that contains hydrogen sulphite and/or sulphite.

11. A method according to claim 7, wherein the additives a) and b) are introduced to the paper in conjunction with pressing the paper during its manufacture.

12. A method according to claim 7, wherein the additives a) and b) are introduced to the paper when surface sizing said paper.

13. A method according to claim 7, wherein the additives a) and b) are introduced to the paper when coating said paper.

14. A method according to claim 7, wherein subsequent to introducing said additives to said paper, the paper is dried on drying cylinders at a highest cylinder temperature greater than 100° C.

* * * * *